US005291935A

United States Patent [19]

Godderidge

[11] Patent Number: 5,291,935

[45] Date of Patent: Mar. 8, 1994

[54] PROCESS FOR THE MECHANICAL CLEANING OF FOUNDRY USED SAND

[75] Inventor: Volker Godderidge, Irdning, Austria

[73] Assignee: KGT Giessereitechnik GmbH, Fed. Rep. of Germany

[21] Appl. No.: 866,558

[22] Filed: Apr. 10, 1992

[30] Foreign Application Priority Data

Apr. 10, 1991 [DE] Fed. Rep. of Germany ..... 4111726

[51] Int. Cl.[5] ..... B22C 5/18

[52] U.S. Cl. ..... 164/5; 241/DIG. 10

[58] Field of Search ..... 164/5; 241/DIG. 10

[56] References Cited

U.S. PATENT DOCUMENTS

| | | | |
|---|---|---|---|
| 2,478,461 | 8/1949 | Connolly | 164/5 |
| 3,230,635 | 1/1966 | Dietert | 164/5 |
| 3,825,190 | 7/1974 | Kauffman | 241/DIG. 10 |
| 4,004,942 | 1/1977 | Richard | 241/DIG. 10 |
| 4,274,360 | 6/1981 | Hofmann | 241/DIG. 10 |
| 4,636,168 | 1/1987 | Sandstrom | 164/5 |
| 4,700,766 | 10/1987 | Godderidge | 164/5 |
| 5,045,090 | 9/1991 | Poli | 241/DIG. 10 |
| 5,115,985 | 5/1992 | Satmer | 241/DIG. 10 |
| 5,163,562 | 11/1992 | Wilhelm | 241/DIG. 10 |

FOREIGN PATENT DOCUMENTS

| | | | |
|---|---|---|---|
| 0060394 | 9/1982 | European Pat. Off. | 164/5 |
| 0149876 | 7/1985 | European Pat. Off. | 241/DIG. 10 |
| 3636479 | 5/1988 | Fed. Rep. of Germany . | |
| 3825361 | 2/1990 | Fed. Rep. of Germany . | |

*Primary Examiner*—Paula A. Bradley
*Assistant Examiner*—James Miner

[57] ABSTRACT

The invention relates to a process for the mechanical cleaning of foundry used sand by means of thermomechanical regenerations, in which the sand is blown pneumatically against a deflection hood and the mechanical-pneumatic cleaning is performed batchwise in a separate container. The process can be used both as pre-cleaning and as after-cleaning. In the case of pre-cleaning there is a simultaneous drying, preheating, pre-cleaning and sifting, whereas with after-cleaning there is a simultaneous cooling, after-cleaning and sifting. As a result of the batchwise operation, all the quartz particles are exposed roughly to the same friction treatment and consequently, in conjunction with a simple control of the cleaning process, reduced grain destruction is achieved.

12 Claims, 2 Drawing Sheets

PROCESS FOR THE MECHANICAL CLEANING OF FOUNDRY USED SAND

Figure 1:
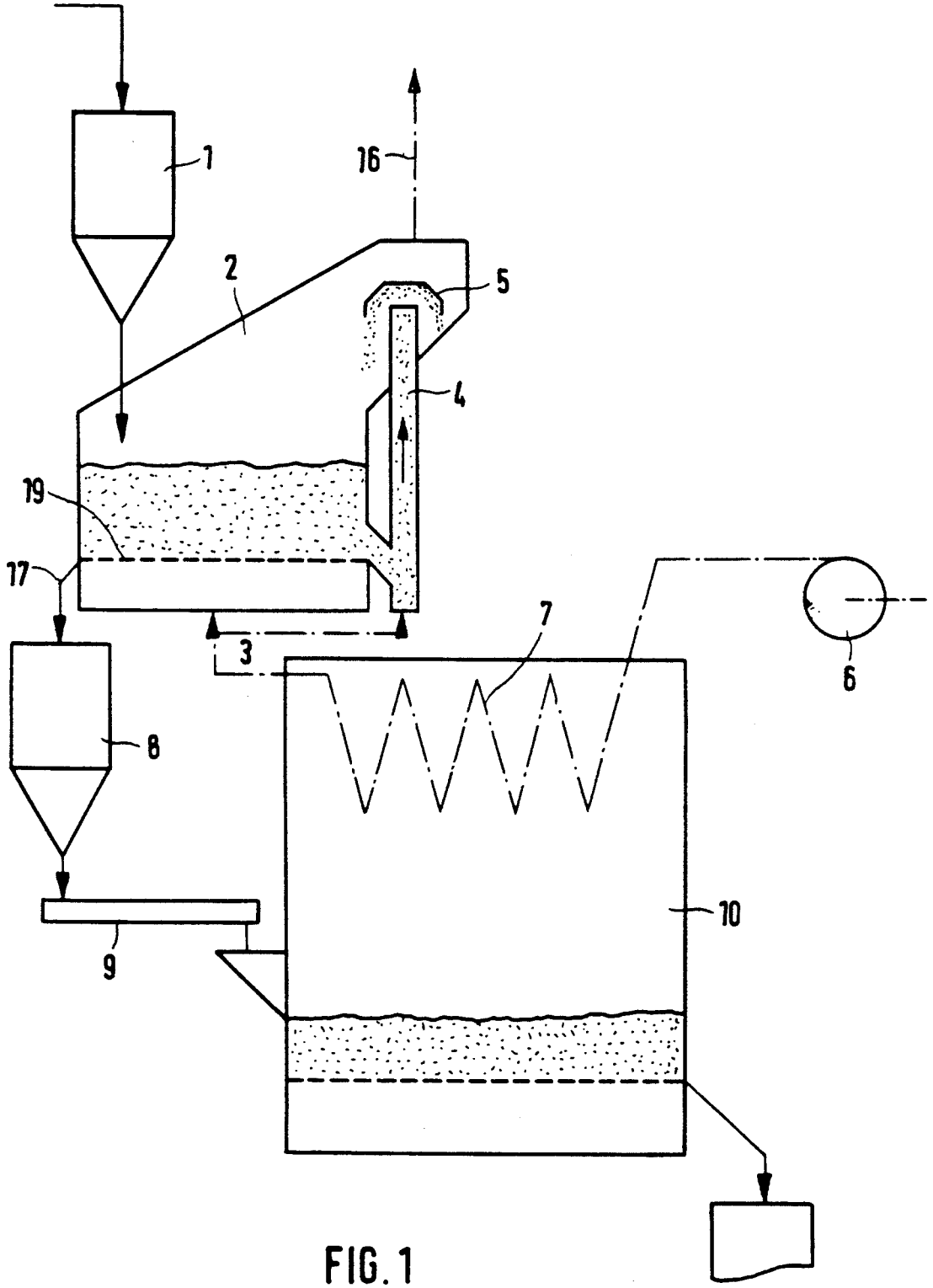

The present invention relates to a process for the mechanical cleaning of foundry used, old or spent sand by thermomechanical regeneration, said sand being pneumatically blown against a deflection or guide hood.

It is known in processes for the thermomechanical regeneration of foundry used sand to carry out a pneumatic-mechanical after-cleaning following a thermal regeneration stage, e.g. in a fluidized bed furnace. The thermally regenerated foundry used sand is cooled in a delivery silo placed between the pneumatic-mechanical after-cleaning stage and is subsequently supplied by means of a pneumatic conveyor to a sifter. The cooled foundry used sand is blown by means of a delivery line in the sifter against an impact bell and subsequently a conventional sifting of said foundry used sand takes place in the latter (DE-OS 3,636,479).

This continuously operating procedure only leads to an insignificantly better cleaning effect than in the conventional sifting process. The impurities adhering to the used sand following a thermal regeneration can only be blown off during the initial impact on the impact bell. However, experience has shown that a single mechanical impact action is not sufficient for foundry used sand, for the purpose of removing all the impurities from its surface, so that the foundry old sand cleaned by this process does not achieve the necessary new sand quality. It is only possible in the sifter to discharge the impurities scaled off from the foundry used sand. The impurities which have not been removed by impact on the impact bell, are still left as dead substances on the sand and prevent or hinder its reuse as high-quality core sand. This is particularly critical in the case of foundry used sand mixtures of core and green sand. The organic binders of the core sand fraction are normally satisfactorily burnt by means of a thermal regeneration, whereas the active, inorganic bentonite of the green sand is transferred into a passive, dead phase (dead burning). This dead burnt bentonite is extremely problematical and can usually only be incompletely removed from the quartz grains of the foundry used sand, because as a result of the thermal treatment it has been sintered onto the quartz grains of said foundry used sand. As a result of said sintered on bentonite, the thermomechanically regenerated foundry used sand cannot be used for core production and cannot be employed in green sand mould production.

Despite the relatively complicated thermomechanical regeneration, there is still a considerable foundry used sand proportion, which cannot be used for mould or core production and which must be dumped in the hitherto conventional manner. A largely complete reuse of foundry used sand for mould or core production is not possible.

A process is also known for regenerating foundry waste sands, which contain used sand mixtures with organic and inorganic binders, active and dead burnt bentonite and synthetic resins, as well as possibly further sludges. In this process there is firstly a dry preregeneration, a subsequent thermal regeneration and an after-cleaning. In the dry preregeneration phase the grains of the foundry used sand are preferably horizontally, radially accelerated and hurled against the stationary baffle plates. During the preregeneration, the foundry spent sand is dried and preheated by the warm waste gas from the thermal regeneration phase flowing over it in counterflow (EP 0,149,595).

In this procedure a high level of wear occurs due to the mechanically moving parts and the dust given off during cleaning, so that the necessary reliability can only be ensured by a corresponding maintenance level. For the drying principle used with the warm waste gas from the thermal regeneration phase flowing in counterflow over the foundry sand, a correspondingly high time expenditure is required.

The problem of the invention is to so thermomechanically clean foundry used sand, that it has a constant quality, which is close to that of new sand.

According to the invention this problem is solved in that the foundry used sand before and/or after a thermal regeneration undergoes batchwise in a separate apparatus a mechanical-pneumatic cleaning. Following the filling of the container the foundry used sand above a metal plate provided with openings (preferably nozzle screws) fitted at a distance from its bottom, is sucked by an air flow passing out of a blast nozzle spaced from a vertical blast pipe into the latter. The used sand accelerated by the air flow passes through the blast pipe to a deflection hood fitted above the latter and is hurled against its inner surface. The impurities adhering to the foundry used sand are scaled off and, by means of the air flow in the container, can be discharged through an opening located on its top. The relatively heavy foundry used sand drops once again onto the container plate provided with the openings and then with the aid of the air flow again through the blast pipe to the deflection hood, so that the cleaning process can be repeated until the desired cleaning effect is obtained. At this time a valve located on the container can be opened and the now cleaned foundry used sand can either be supplied to a following thermal regeneration or to mould/core production, as a function of whether the mechanical-pneumatic cleaning is intended as a pre-cleaning or after-cleaning stage. This procedure ensures that the foundry used sand leaving the container has a constant quality and that all the particles or grains of said sand are subject to an almost identical number of cleaning cycles in the container.

As a result of the parallel connection of at least two such cleaning containers a quasi-continuous operation of a foundry used sand cleaning plant is ensured.

In the pneumatic-mechanical cleaning there is almost no mechanical wear as a result of a corresponding material choice for the nozzle, blast pipe and deflection hood. The cleaning effect of the foundry used sand can easily be regulated by varying the air feed pressure, modifying the spacing on the blast pipe end and on the deflection hood, as well as a corresponding setting of the impact angle of the foundry old sand on the deflection hood and the duration of the cleaning process. The deflection hood fixed to the top of the container can be fixed by simple mechanical means in different spacings from the blast pipe end and can optionally be pivoted by certain angles. As a result it is possible to achieve greater cleaning effects at the start of the cleaning process and to bring about a more gentle treatment of the particles towards the end of the cycle.

If the pneumatic-mechanical cleaning is used as a pre-cleaning stage, advantageously hot air can be used for feeding and fluidizing the used sand. The air is advantageously heated utilizing the waste heat from the thermal regeneration process. In the case of hot air temperatures above 350° C. a reliable, rapid drying, particularly of inorganic impurities is possible. The mechanical pre-cleaning of the bentonite-bound used sand is made more difficult by the residual moisture necessarily present. The still active bentonite absorbs a large amount of water and acts like a "lubricant". This reduces the cleaning effect caused by grain-on-grain friction. As a result Of the hot feed and fluidizing air flowing all round the used sand, the bentonite layer adhering thereto is very rapidly dried and embrittled, so that it can be more easily mechanically removed. Following adequate pre-cleaning and drying the valve on the container is opened and the now preheated and precleaned used sand can be supplied to a thermal regeneration stage, such as a fluidized bed furnace. In the latter the organic binders still adhering to the used sand are cleaned off and the still adhering bentonite is "dead burnt".

The thermal regeneration stage can be followed by a similar pneumatic-mechanical cleaning. It is advantageous to provide a heat exchanger in the container interior above the perforated metal plate and which cools the used sand dropping from the deflection hood. The thermally regenerated used sand passes into the container at a temperature of approximately 650° C. The fire clay shells of the quartz grains are softer in this state than after cooling to approximately 50° C. This leads to a gentler cleaning of the fire clay shells than at comparatively low temperatures, so that a lower grain destruction is to be expected. As a result of the cooling to be carried out in the container the bentonites undergo embrittlement and thermal stresses occur, which permits simpler separation.

The invention is described in greater detail hereinafter relative to two embodiments and the attached drawings, wherein show:

FIG. 1 a pneumatic-mechanical cleaning of foundry used sand with subsequent thermal regeneration in a fluidized bed furnace.

Figure 2:
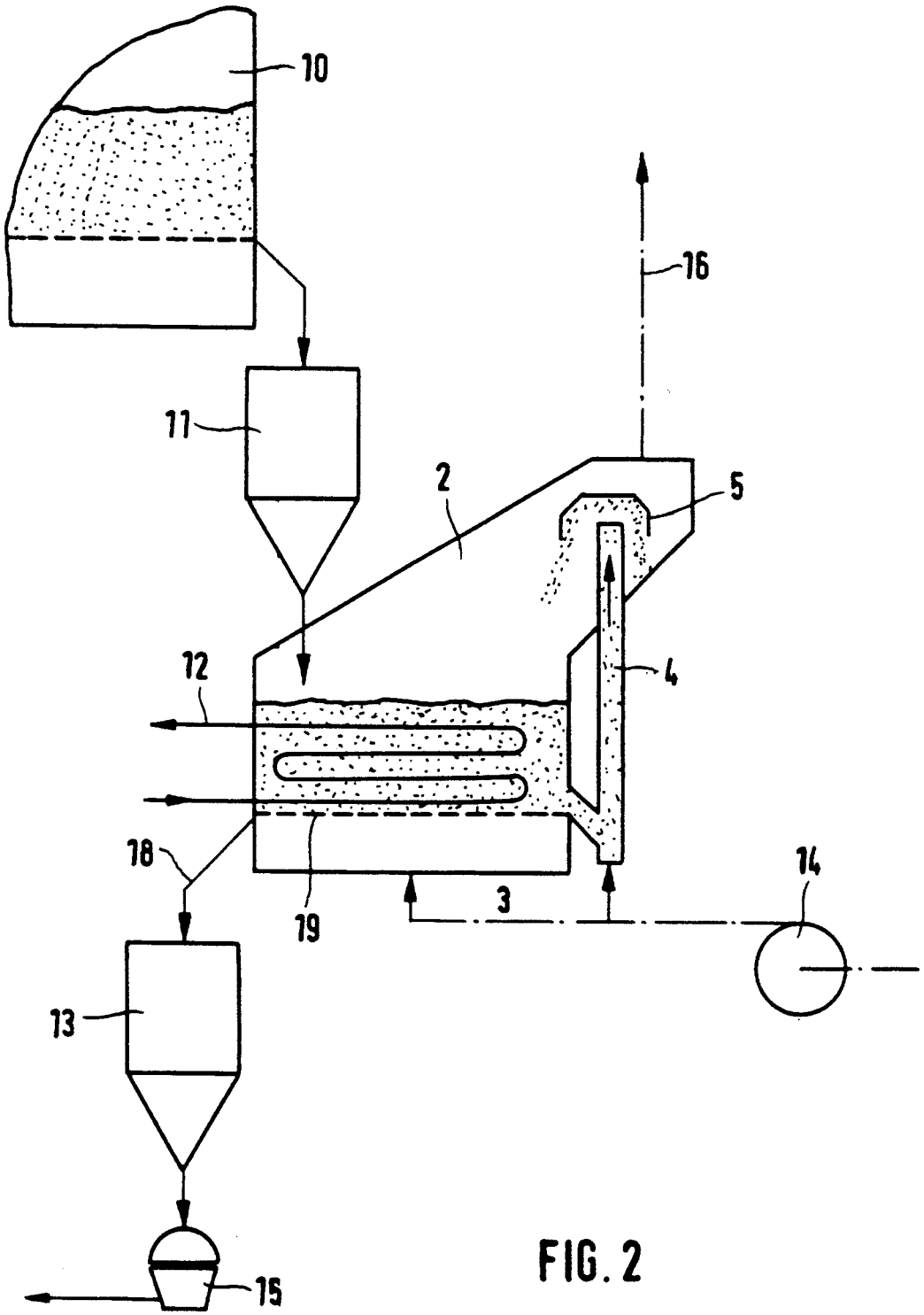

FIG. 2 a pneumatic-mechanical after-cleaning following onto a thermal regeneration in a fluidized bed furnace.

In the case of a pre-cleaning according to FIG. 1 the foundry used sand passes from a preliminary container 1 into the cleaning container 2. An air flow is produced by a blower 6 and passes through the heat exchanger 7 and is heated therein by the heat of the fluidized bed furnace 10. The air is heated in the heat exchanger 7 to 400° to 500° C. (at least 350° C.). The now hot air passes through the air guide 3 into the cleaning container 2 and delivers the used sand through the blast pipe 4. The used sand accelerated by the air flow impacts against the deflection hood 5 and impurities adhering thereto and more particularly inorganic binders are scaled off. As a result of the very hot feed medium air, which flows all round the old sand, there is a very rapid drying of the bentonite, which embrittles and can consequently be more easily removed from the sand.

Following impact on the deflection hood 5 the old sand drops onto the perforated metal plate 19, which is fitted above the cleaning container bottom. In the openings of the plate 19 are provided nozzle screws, preferably transversely drilled hollow screws, through which the air flows into the cleaning container 2 and fluidizes the used sand. The foundry used sand on the cleaning container bottom plate 19 again passes to the blast pipe 4 and is sucked into the latter by means of the air flow. The used sand passes through this circuit until a particular drying and cleaning effect or a particular preheating temperature is obtained and is then removed from the cleaning container 2 by means of the line 17. The cleaning container 2 contains a not shown shutoff device, which opens or closes the line 17. From the line 17 the precleaned used sand passes into an intermediate container 8 and is supplied by means of a vibrating conveyor 9 to a fluidized bed furnace 10, in which the used sand undergoes thermal regeneration.

The air can be controlled by known, not shown means, such as e.g. flaps in such a way that no air passes to the blast pipe 4 and the air flow only passes through the openings in the bottom plate 19 and the foundry used sand is fluidized and predried in the cleaning container 2. Blast air is only supplied to the blast pipe 4 after a certain predrying. The openings uniformly distributed over the bottom plate 19, preferably in the form of transversely drilled hollow screws or nozzles, uniformly distribute the air flow over the entire surface and prevent the used sand from dropping down. As a result the total sand content is fluidized, so that there is a rapid heat transfer between the air and the sand and there are favourable conditions for a fluidized bed sifting.

As a result of the pressure and flow conditions prevailing in the cleaning container 2, it is possible, without significant additional expenditure, to draw off the scaled off, light residual and usable materials by means of a discharge outlet 16 fitted to the top of the cleaning container 2.

At the start of the pre-cleaning the drawn off residual and usable materials separated in a not shown cyclone separator have a high concentration of bentonite and whole carbon, which are immediately supplied again to green sand preparation. However, if the proportion of quartz fines in the dust increases, the dust separated in the cyclone separator is supplied to the fluidized bed furnace 10 for burning in the organic constituents and rendering the residual substances inert.

FIG. 2 shows the basically identically constructed cleaning container 2 following onto a thermal regeneration stage, in the form of a fluidized bed furnace 10. The hot used sand passes via an intermediate container 11 into the cleaning container 2, which has a heat exchanger 12 for cooling the hot used sand above the perforated plate 19. In principle, the pneumatic-mechanical after-cleaning operates in the same way as the corresponding pre-cleaning. However, cold air is delivered to the cleaning container 2 via a blower 14 and through the air guide 3. Thus, in conjunction with the heat exchanger 12, it is possible to ensure a rapid cooling of the previously hot used sand. As a result of the repeated acceleration of the used sand in the blast pipe 4 and the subsequent impacting on the deflection hood 5, it is ensured that the dead burnt bentonite still adhering to the sand particles are detached. After a predetermined time, i.e. a correspondingly defined number of cycles, the cleaning process is ended and as a result all the quartz particles have roughly been subject to the same friction treatment. As from this time and after opening a not shown valve, the now completely cleaned foundry sand can be supplied through the line 18 to a further intermediate container 13 and passes via a pneumatic conveyor 15 to mould or core production.

As almost no mechanically moving parts are present, there is no mechanical wear, so that only limited maintenance is required for operating this plant.

As a result of the favourable regulating possibilities and the possibility of predetermining the cleaning time (number of cycles), it is ensured that grain and particle destruction is reduced. The thus cleaned foundry used sand can largely be supplied in the manner of new sand to mould or core production.

As a result of the combination of several operations in one plant part, an economic operation of a foundry used sand cleaning plant is ensured. Thus, in a pre-cleaning stage, the foundry used sand can be simultaneously dried, preheated, precleaned and in the pneumatic-mechanical after-cleaning simultaneously cooled, after-cleaned and sifted. This obviates the need for additional equipment, such as e.g. intermediate conveyor systems, which are necessary in other plant types.

For the continuous operation of a foundry used sand cleaning plant, it is obvious to have at least two corresponding pneumatic-mechanical pre and/or after-cleaning plants operating in parallel, whose capacity is of a corresponding value. As a function of the necessary capacity one or more blast pipes can be provided in the cleaning containers, through which the air flow blows the old sand against one of more deflection hoods.

I claim:

1. A process for the cleaning of used foundry sand, comprising the steps of, in sequence:

(a) heating and mechanically pre-cleaning the sand in a batchwise manner in a pre-cleaning container by repeatedly pneumatically blowing the sand through a vertically positioned blast pipe with hot air against a deflection hood until an adequate cleaning level is achieved, the cleaning level being measured as a function of two or more in combination of the degree of contamination, degree of moisture and temperature in the preheating container, and (b) thermally regenerating the sand in a regeneration container.

2. The process of claim 1, further comprising the step of cooling the sand and mechanically after-cleaning the sand in an after-cleaning container in a batchwise manner by pneumatically blowing the sand against a deflection hood.

3. The process of claim 2, wherein a heat exchanger is provided for cooling the sand within the after-cleaning container.

4. The process of claim 2, comprising cooling the sand in the after-cleaning container by fluidizing the sand with cool air.

5. The process of claim 1, wherein the air in step (a) is heated to a temperature sufficient to dry a bentonite layer surrounding the sand so as to ease removal of the layer during mechanical pre-cleaning.

6. The process of claim 5, wherein the air is heated to a temperature of at least 350° C.

7. The process of claim 5, wherein the angle of the deflection hood is adjustable.

8. The process of claim 5, wherein the air is heated via a heat exchanger in the regeneration container.

9. A process for the cleaning of used foundry sand comprising quartz fines and organic matter, comprising the steps of, in sequence:

(a) heating and mechanically pre-cleaning the sand in a batchwise manner in a pre-cleaning container by pneumatically blowing the sand with hot air against a deflection hood, while simultaneously drawing off the quartz fines and organic matter through an opening in an upper area of the pre-cleaning container for use in green sand preparation until the proportion of quartz fines to organic matter increases to a certain value where efficient reclamation of the quartz fines becomes possible, and (b) thermally regenerating the sand in a regeneration container.

10. The process of claim 9, further comprising the step of, after reaching said certain value, supplying the quartz fines and the organic matter to the regeneration container for burning of the organic matter.

11. A process for the cleaning of used foundry sand, comprising the steps of, in sequence:

(a) pre-heating the sand in a pre-cleaning container by fluidizing the sand with hot air, (b) heating and mechanically pre-cleaning the sand in a batchwise manner in the pre-cleaning container by pneumatically blowing the sand with hot air against a deflection hood, and (c) thermally regenerating the sand in a regeneration container.

12. The process of claim 11, further comprising a step (d) of cooling the sand and mechanically after-cleaning the sand in an after-cleaning container in a batchwise manner by pneumatically blowing the sand against a deflection hood.

* * * * *